US011428459B1

(12) United States Patent
Greenwood

(10) Patent No.: US 11,428,459 B1
(45) Date of Patent: Aug. 30, 2022

(54) FREEZER RACK

(71) Applicant: YouCopia Products, Inc., Chicago, IL (US)

(72) Inventor: Mark Greenwood, Arlington Heights, IL (US)

(73) Assignee: YouCopia Products, Inc., Chicago, IL (US)

( * ) Notice: Subject to any disclaimer, the term of this patent is extended or adjusted under 35 U.S.C. 154(b) by 43 days.

(21) Appl. No.: 17/218,728

(22) Filed: Mar. 31, 2021

(51) Int. Cl.
*F25D 25/02* (2006.01)
*A47B 57/58* (2006.01)
*F25D 23/06* (2006.01)

(52) U.S. Cl.
CPC ..... *F25D 25/021* (2013.01); *A47B 57/58* (2013.01); *F25D 23/069* (2013.01); *F25D 2325/021* (2013.01); *F25D 2331/809* (2013.01); *F25D 2331/812* (2013.01)

(58) Field of Classification Search
CPC ..... F25D 25/021; F25D 2325/021; F25D 23/069; F25D 2331/809; F25D 2331/812; A47B 57/58
See application file for complete search history.

(56) References Cited

U.S. PATENT DOCUMENTS 2,610,759 A * 9/1952 Slade ..... F25D 23/069 220/533
7,703,866 B2 * 4/2010 Benz ..... F25D 25/02 312/408
2003/0098635 A1 * 5/2003 Berezovskiy ..... F25D 25/021 312/408

FOREIGN PATENT DOCUMENTS

GB 2476464 B * 8/2016 ..... F25D 25/00

* cited by examiner

*Primary Examiner* — Andrew M Roersma
(74) *Attorney, Agent, or Firm* — Lowe Graham Jones PLLC

(57) ABSTRACT

A storage rack suitable for a freezer includes a base platform having a plurality of ribs defining a corresponding plurality of channels. One or more dividers may be removably seated within a selected channel. The dividers include a divider platform having a pair of downwardly extending arms terminating in inward hooks which engage the base platform.

20 Claims, 15 Drawing Sheets

FREEZER RACK

BACKGROUND OF THE INVENTION

Storing items in a freezer can sometimes be awkward and clumsy, particularly when the items are contained in flexible packaging. Sometimes frozen items can be stacked, but that orientation can make removal difficult when a desired item is at or near the bottom. More preferably, frozen food items could be stored efficiently next to one another, without stacking. To address this concern, the present invention relates to a configurable rack with selectively moveable dividers to provide slots for receiving and storing items. The rack is particularly useful for a freezer, but may also be used for other kitchen storage purposes.

SUMMARY OF THE INVENTION

A preferred version of the freezer rack includes a base platform having a first end and an opposing second end, with a first side and an opposing second side positioned between the first end and the second end. A base platform length is defined between the first end and the second end, and a base platform width defined between the first side and the second side. The base platform further has an upper surface, a lower surface, a first sidewall at the first end between the upper surface and the lower surface, and an opposing second sidewall at the second end between the upper surface and the lower surface.

A plurality of ribs is provided on the base platform, each of the ribs extending along the first sidewall, across the width of the base platform, and along the second sidewall. Alternatively, the ribs may be configured as pairs of side ribs positioned on each side of the base platform, without rib portions extending across the entire width of the base platform.

The plurality of ribs further are spaced apart from one another between the first end and the second end to define a plurality of channels between adjacent ribs from among the plurality of ribs.

At least one divider is removably attachable to the base platform within a selected one of the plurality of channels, the at least one divider having an upper wall extending from a divider base, the divider base terminating in a first connector and an opposing second connector, the first connector being releasably securable to the lower surface of the base platform at the first sidewall and the second connector being releasably securable to the lower surface of the base platform at the second sidewall.

In a preferred version, each of the ribs extends continuously from the first sidewall, across the width of the base platform, and along the second sidewall. In other versions, the ribs may extend across the base platform in the same manner, but may be discontinuous.

In some versions, the first connector terminates in a first hook attachable to the lower surface of the base platform, and the second connector terminates in a second hook attachable to the lower surface of the base platform.

The first connector includes a first flexible arm, the first flexible arm being in contact with the first sidewall when the at least one divider is mounted to the selected one of the plurality of channels.

The second connector includes a second flexible arm, the second flexible arm being in contact with the second sidewall when the at least one divider is mounted to the selected one of the plurality of channels.

Preferably, the first hook terminates in a first inclined inner surface, the first inclined inner surface engaging the first sidewall when the at least one divider is pressed downwardly into the selected one of the plurality of channels.

In some versions, the divider base comprises a divider base width and each of the plurality of channels comprise a channel width, the divider base width being substantially equal to the channel width.

In some versions, the divider base comprises a divider base width and each of the plurality of channels comprise a channel width, the divider base width being greater than the channel width.

In preferred versions, the first end comprises a first vertical end wall and the second end comprises a second vertical end wall.

Most preferably, the at least one divider comprises a plurality of dividers.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
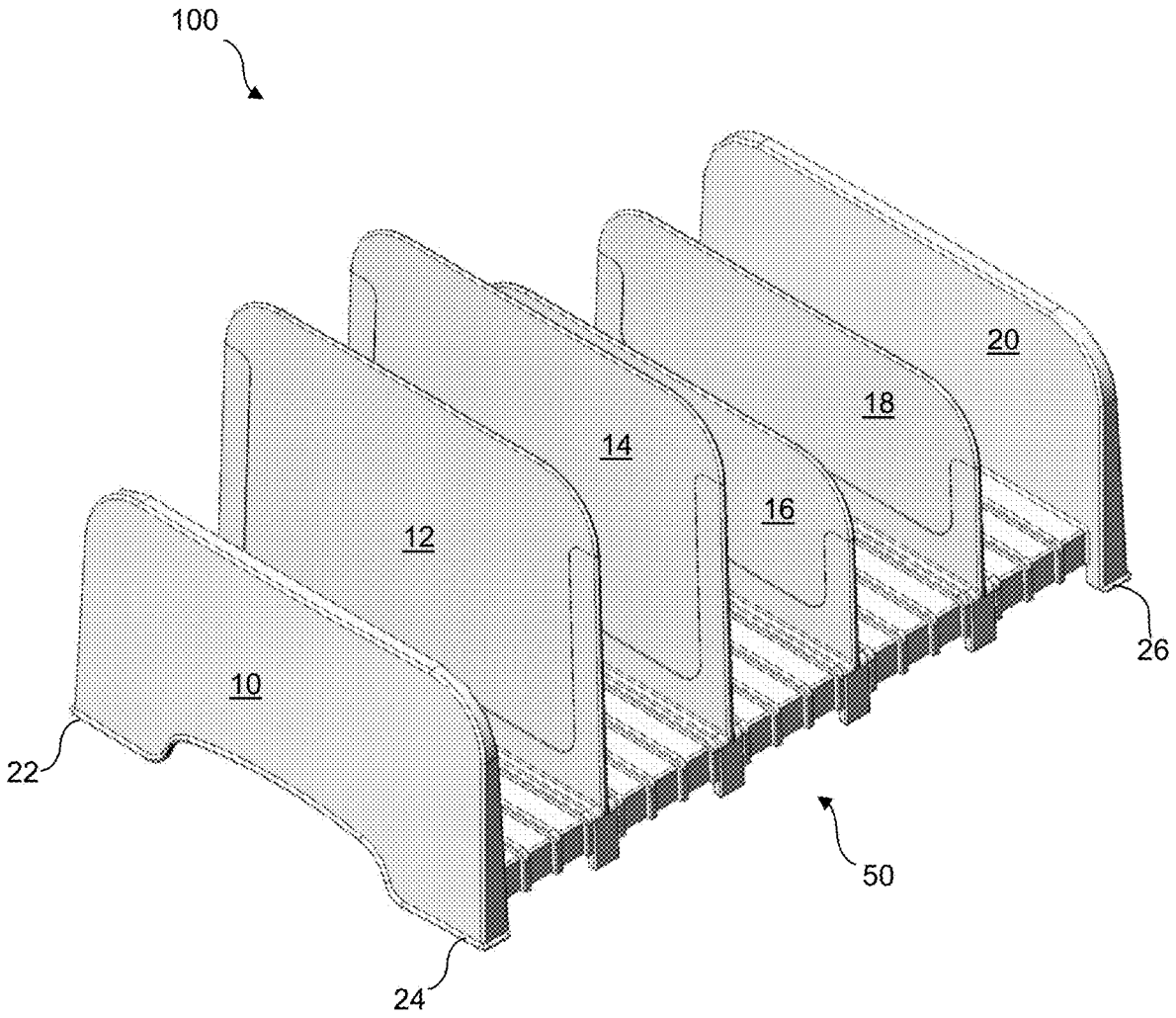
FIG. 1 is a front top perspective view of an exemplary freezer rack.

An exemplary freezer rack 100 is shown in the accompanying figures, including a top perspective view in FIG. 1. Although the invention is referred to as a "freezer rack" in this description, it should be appreciated that the rack may work equally well in a refrigerator, in a cupboard, or on a countertop.

The preferred freezer rack includes a base tray 50 having a first end 10 and an opposing second end. The base tray is supported by a plurality of feet 22, 24, 26, 28 in the preferred version, although in other versions it may have a different base or platform configuration for supporting the base tray on a horizontal surface. The base tray 50 defines a length L extending between the first end and the second end (see FIG. 2), and in the preferred version the base tray is a solid structure formed from plastic or other materials. A tray width W extends perpendicularly to the length, from one side to the other. In other versions the base tray need not be solid, but rather may have a number of open spaces and may be formed from wire or other materials.

Figure 3:
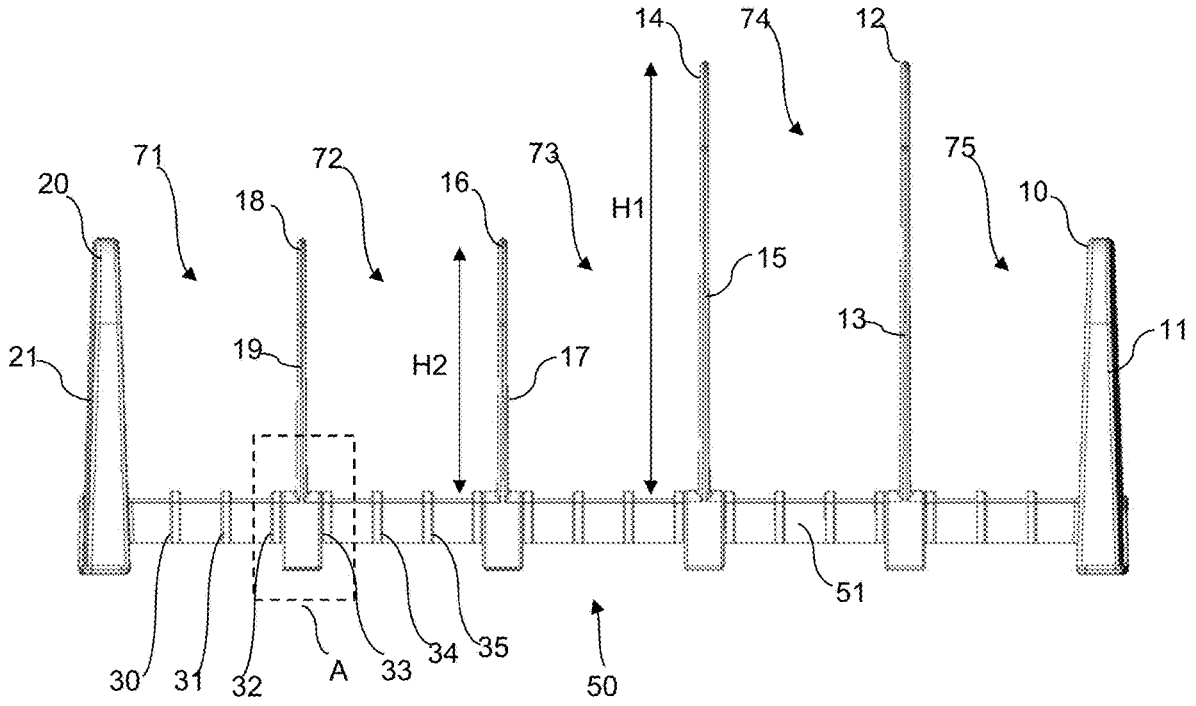
FIG. 3 is a front elevational view of the freezer rack, the rear elevational view being a mirror image.

In the illustrated example, the first end 10 and the second end 20 each are configured as an upright end wall extending upwardly in a direction away from the feet, and substantially perpendicularly with respect to a plane defined by the base tray. One or more dividers 12, 14, 16, 18 may be received by and retained on the base platform, and serve to define spaces on the platform to receive a frozen food item or other object for storage. As seen in FIG. 3, the dividers may have varying heights above the base platform, with one or more of the dividers 12, 14, having a height H1 which is taller than a height H2 for the others 16, 18. As described further below, the dividers are preferably removable from the base platform and can be positioned in a desired location to define a storage slot of a desired size.

Figure 2:
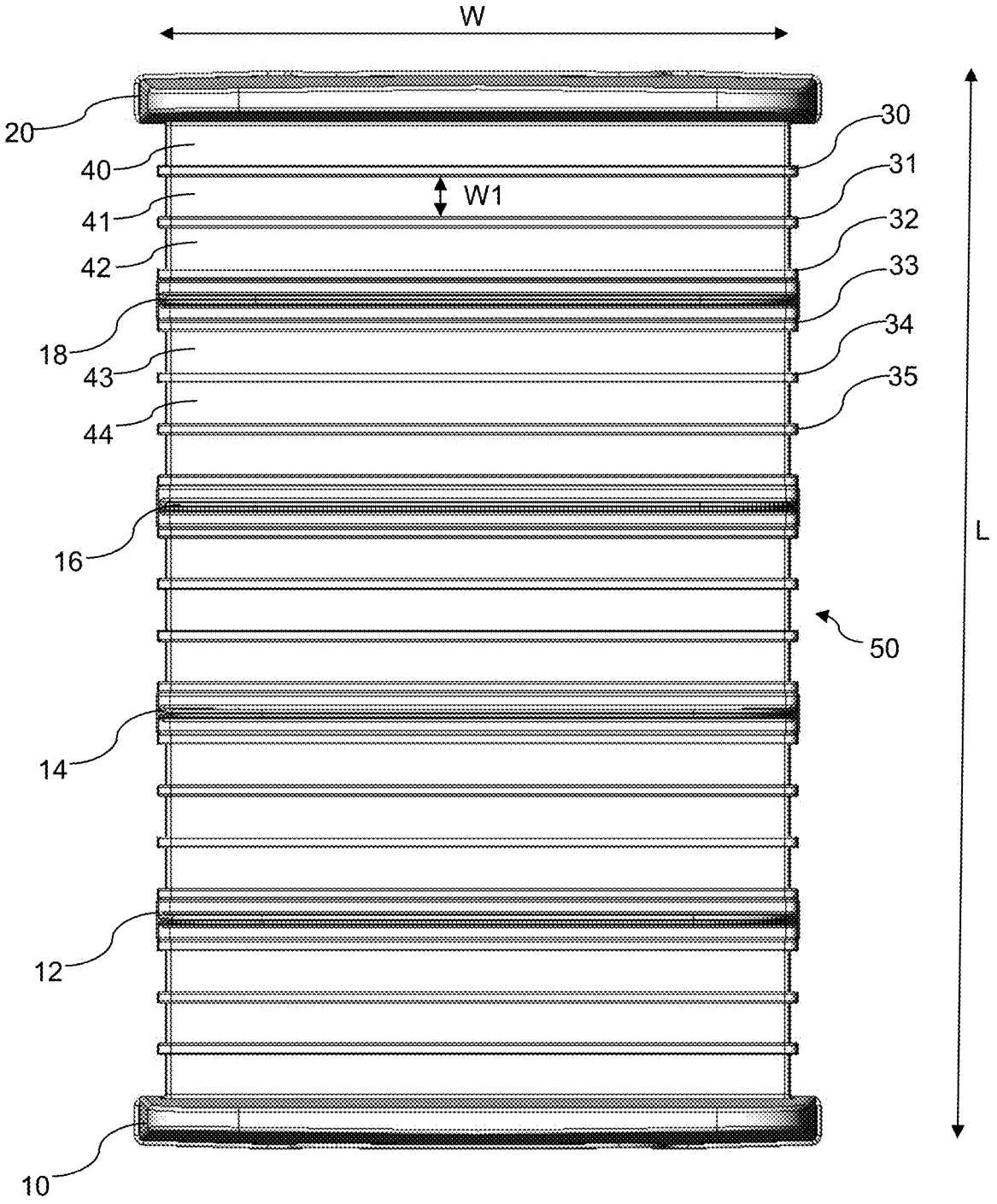
FIG. 2 is a top plan view of the freezer rack.

FIG. 2 depicts a top plan view of the rack of FIG. 1. In this view, some of the additional features of the base platform 50 can be seen. The base platform includes a plurality of ribs 30-35 extending across the width W and spaced apart from one another along the length L of the base platform between the first end 10 and the second end 20. For clarity of illustration, some of the ribs 30-35 are numbered while additional ribs are illustrated but not numbered. Most preferably, the ribs are uniformly spaced apart (by a distance W1, as shown) from one another and are positioned on the base platform along the entire length from the first end 10 to the second end 20. As shown, in the preferred version each of the individual ribs extends continuously across the entire width of the base platform.

The spaced-apart ribs form a plurality of slots 40-44 which are also spaced apart from one another so that the plurality of slots are provided along the entire length of the base platform between the first end 10 and the second end 20. In the illustrated example, four dividers 12, 14, 16, 18 are shown as separately seated in a corresponding one of four slots. Divider 18, for example, is seated in a slot defined between ribs 32 and 33. It should be appreciated that more than four dividers, or fewer than four dividers, could be used. Likewise, the preferred base platform could have a larger or smaller length or width as compared to the illustrated example.

FIG. 3 illustrates a front elevational view of the preferred rack. In this view, the storage spaces 71, 72, 73, 74, 75 are more clearly visible between the corresponding end-walls 11, 21 and the divider walls 13, 15, 17, 19 which define the spaces. Detail area A is indicated, and is described further with respect to FIG. 9. As can be seen in FIGS. 2 and 3, and more readily in FIG. 9, each of the ribs (e.g., 30-35) extends across the upper surface of along the full width of the base platform 50, continuing continuously down a vertical sidewall 51 of the front of the base platform, as well as down a vertical sidewall 54 of the rear of the base platform (the rear vertical sidewall 54 is not visible in FIG. 3, but the rear view of the rack is a mirror image of the front view of FIG. 3). Thus, the ribs each form essentially an inverted U-shape on the base platform.

Figure 4:
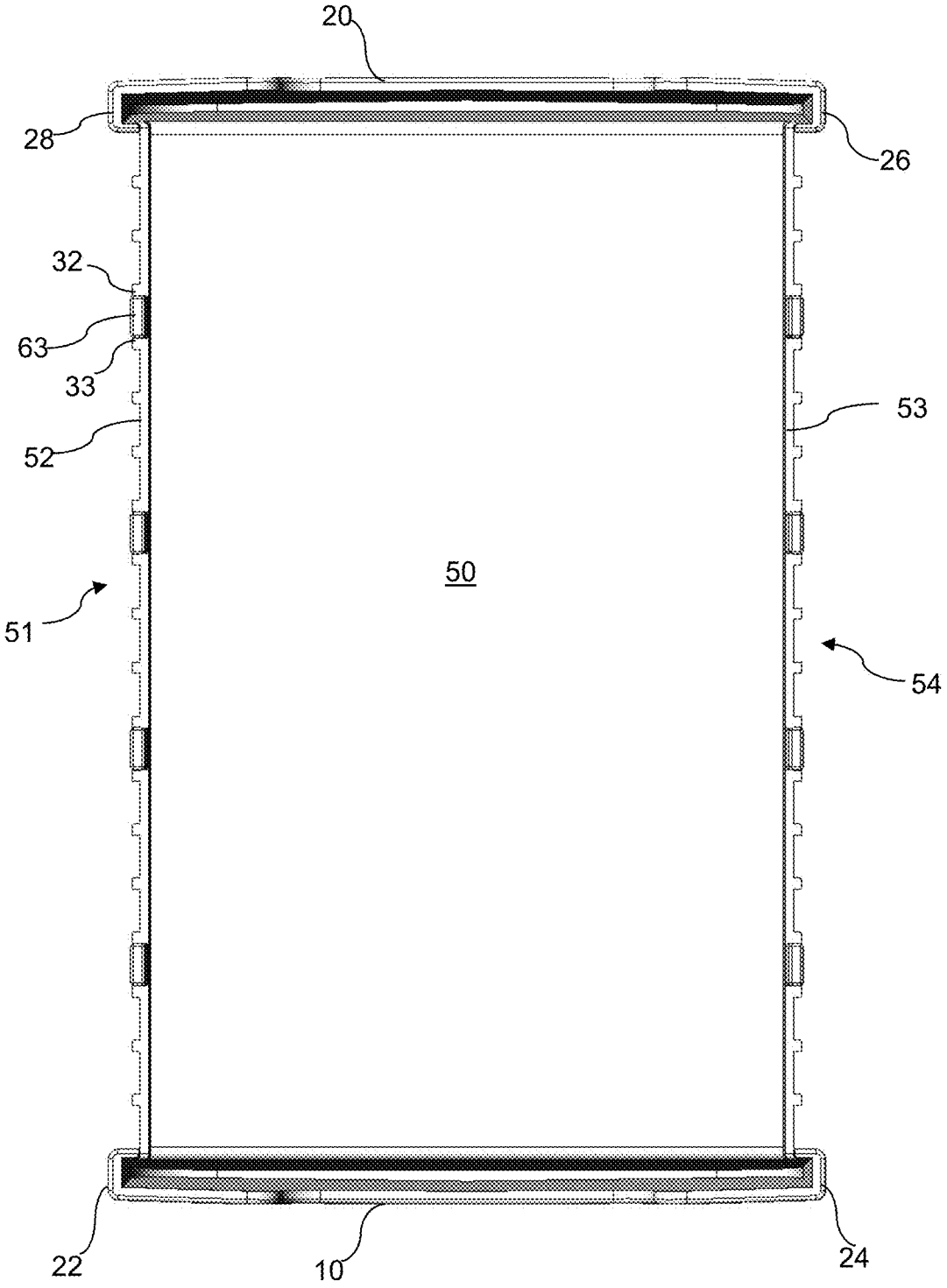
FIG. 4 is a bottom plan view of the freezer rack.
Figure 5:
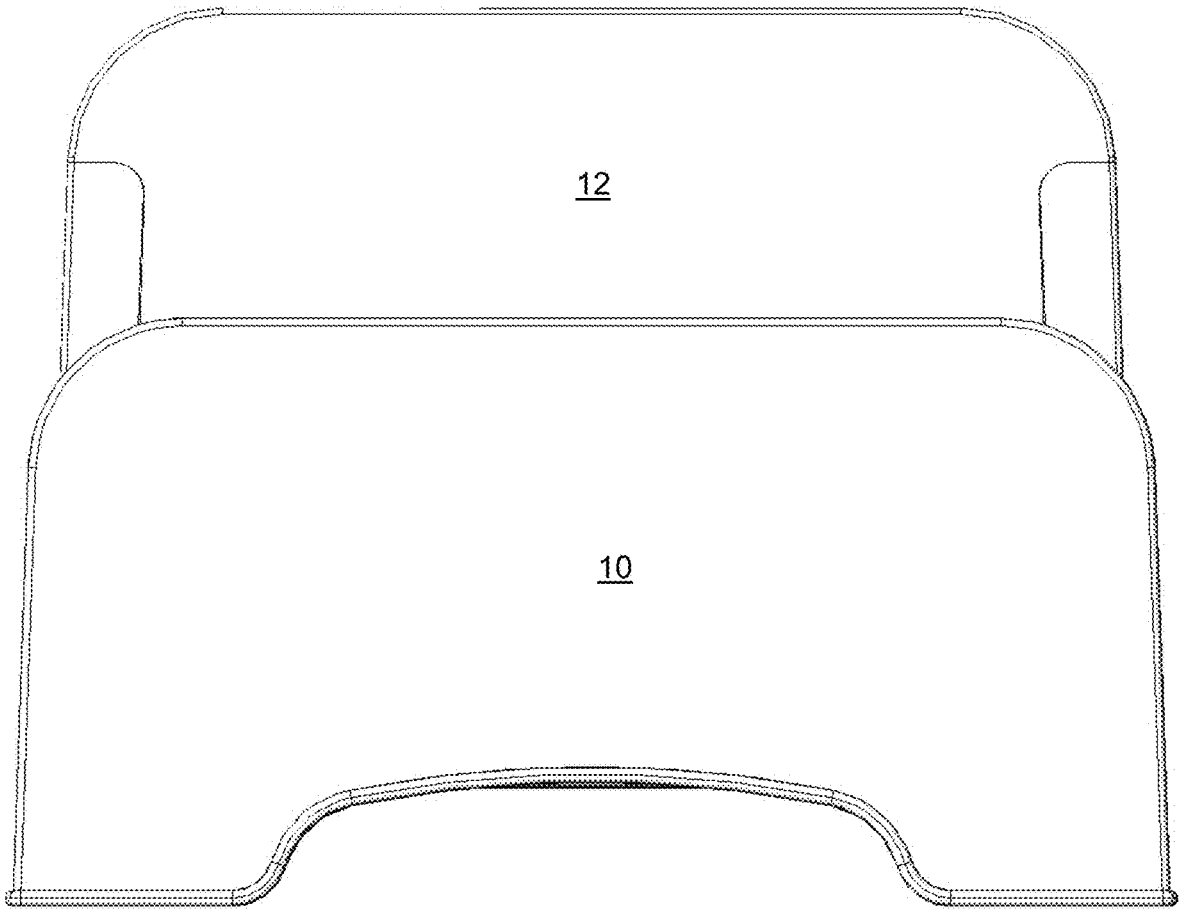
FIG. 5 is a left side elevational view of the freezer rack the right side elevational view being a mirror image.

FIG. 4 is a bottom plan view of the preferred rack. The bottom of the base platform 50 includes a lower surface 52, 53 on either side, at the bottom of each corresponding sidewall 51, 54. Most preferably, the lower surface 52, 53 of the sidewalls 51, 54 forms a shoulder or ledge which is raised above the height of the feet of the base platform for engaging a connector of a divider, as described further below. In the preferred version, a first bottom ledge 52 extends along the entire length from the first end 10 to the second end 20, and a second bottom ledge 53 extends along the opposite side, along the entire length from the first end 10 to the second end 20.

The preferred dividers are formed with connectors having lower hooks, and the lower hooks of the connectors are partially visible in the bottom view of FIG. 4, such as lower hook 63 which is seated between ribs 32 and 33. As described further below, a portion of the lower hook engages the lower surface 52 of the base platform to hold the divider in position. The other dividers are configured in the same fashion, though the hooks and ribs are not numbered for simplicity of illustration.

Figure 6:
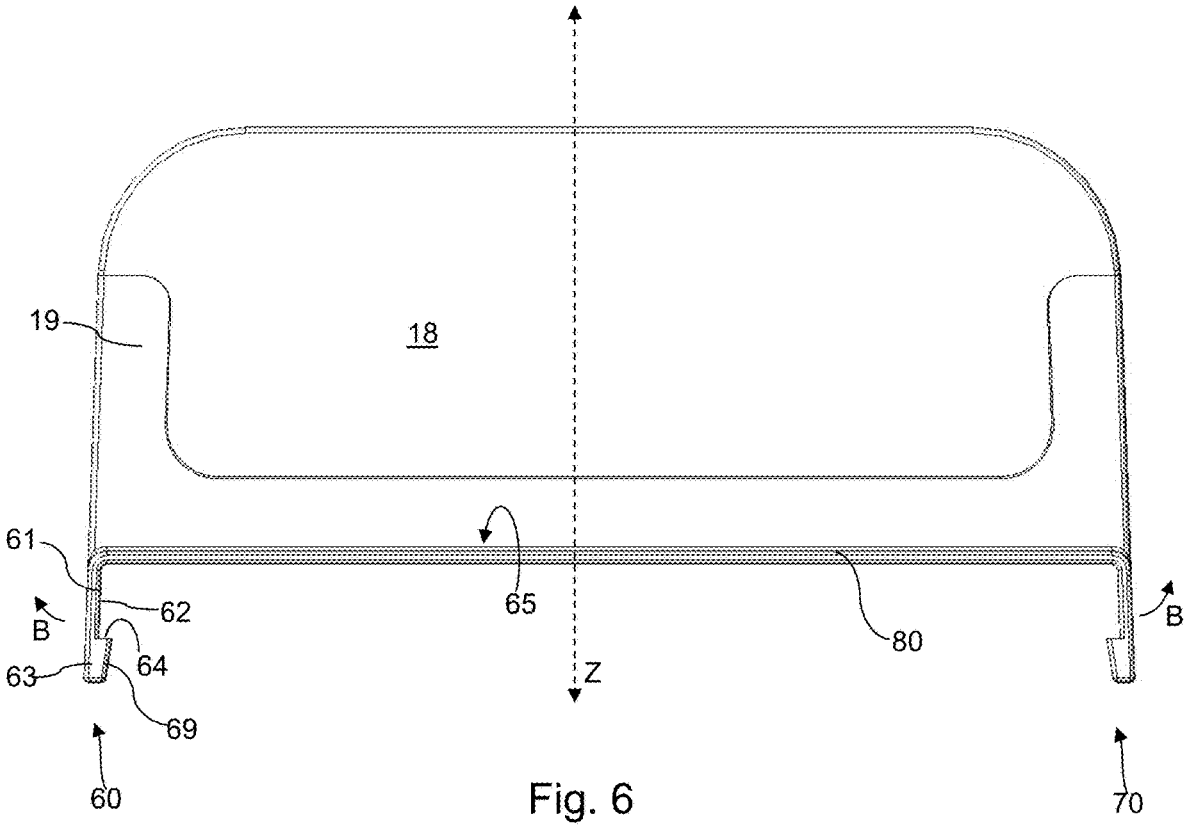
FIG. 6 is a left side elevational view of a divider for a freezer rack.
Figure 7:
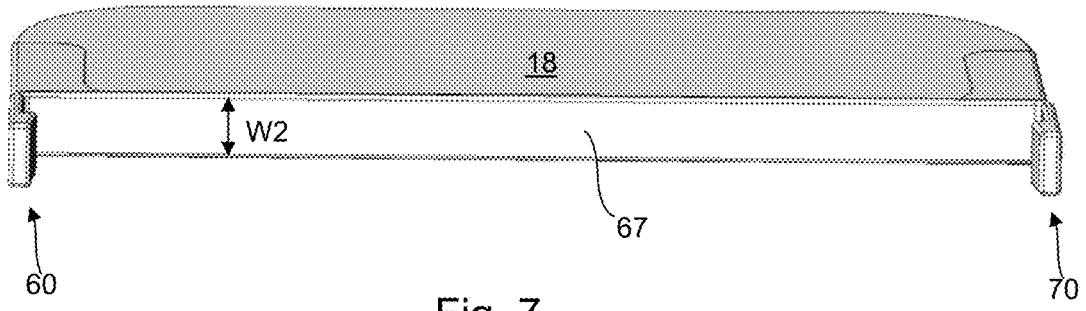
FIG. 7 is a bottom perspective view of a divider for a freezer rack.
Figure 8:
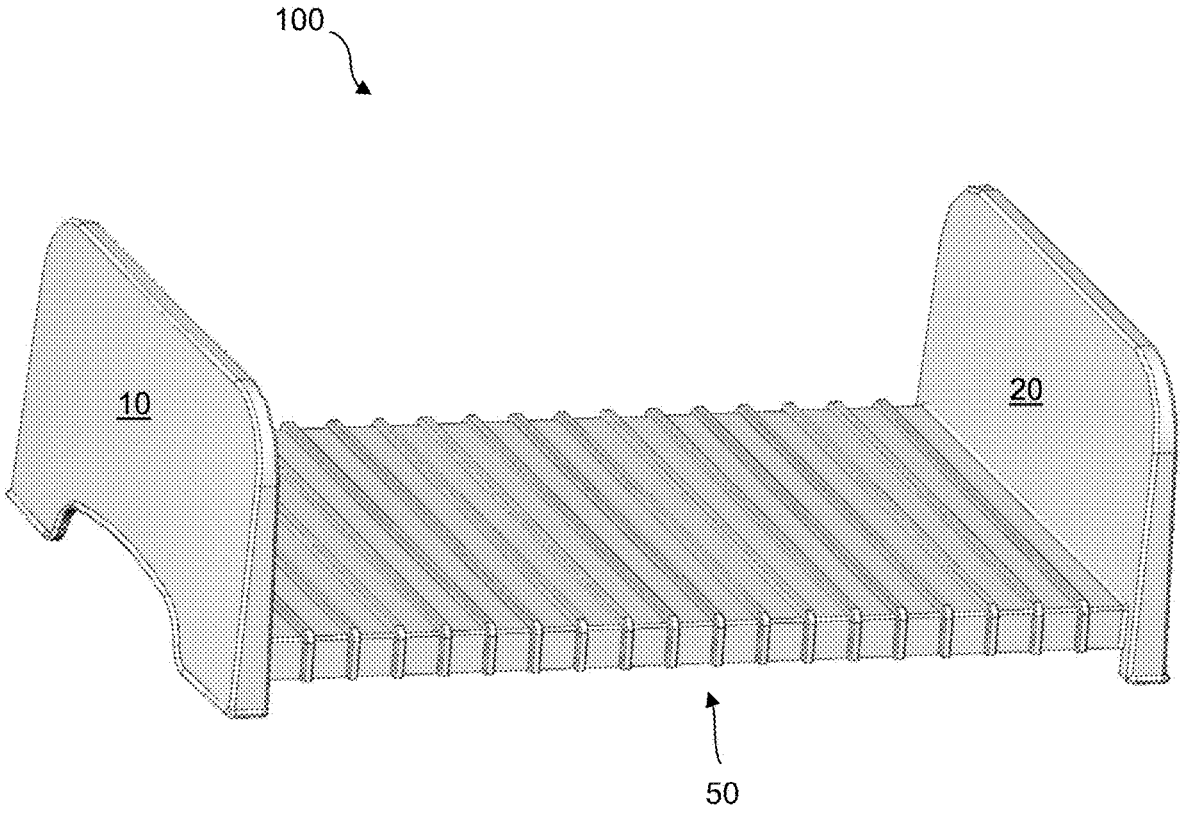
FIG. 8 is a front top perspective view of a base tray for a freezer rack, shown with no removable dividers attached.

FIGS. 6 and 7 illustrate an elevational and a perspective view of a preferred divider for use with the base tray. The majority of the divider is configured as a substantially planar wall. A lower portion of the divider includes a divider base 80 having a lower surface 67 which is configured to seat within any one of the base tray slots as described above. At each end of the divider a downwardly-extending connector 60, 70 is provided. Most preferably, the connectors are integrally formed with the divider and with the divider base, such that the entire divider is integrally formed from a single material such as plastic. Each of the connectors 60, 70 is configured in the same way, and therefore only one of the connectors 60 will be described in detail.

As illustrated, the connector 60 includes a downwardly-extending arm 61 having an inner surface 62. A hook 63 is positioned at the bottom of the connector and includes an upper ledge 64. In the preferred version the ledge forms a planar upper surface and includes a lower interior surface 69 extending below the ledge, in which the lower interior surface is large enough to be pressed upon by a finger of a user as described below. Most preferably, the lower interior surface 69 is inclined such that it tapers outwardly as it extends downwardly from the upper ledge 64, in a direction away from the divider base 80. Thus, the connector is narrower at the distal tip than at the upper ledge.

The arm 61 of the connector is produced with a degree of flexure so that it can bend outwardly, such as in the direction of the arrow B. When a divider is seated on the base platform, the arm is positioned snugly against one of the vertical sidewalls 51 or 54 of the base platform, within a desired slot. Applying an outward force against the interior surface 69 of the hook in the direction of the arrows B causes the arm to bend outwardly to a point in which the hook disengages from the lower surface of the base platform, thereby allowing the divider to be removed from the base platform.

As further seen in FIG. 7, the lower surface 67 of the divider base includes a width W2 extending from one side to the opposing side, in which the width is perpendicular to a length that extends from a first connector 60 to the opposing second connector 70 (and which is substantially equal to the width W of the base platform). In a preferred version, the width W2 is substantially equal to the width W1 defining the width of the slots, such that the divider base contacts each of the opposing ribs when a divider is seated within a slot.

Figure 9:
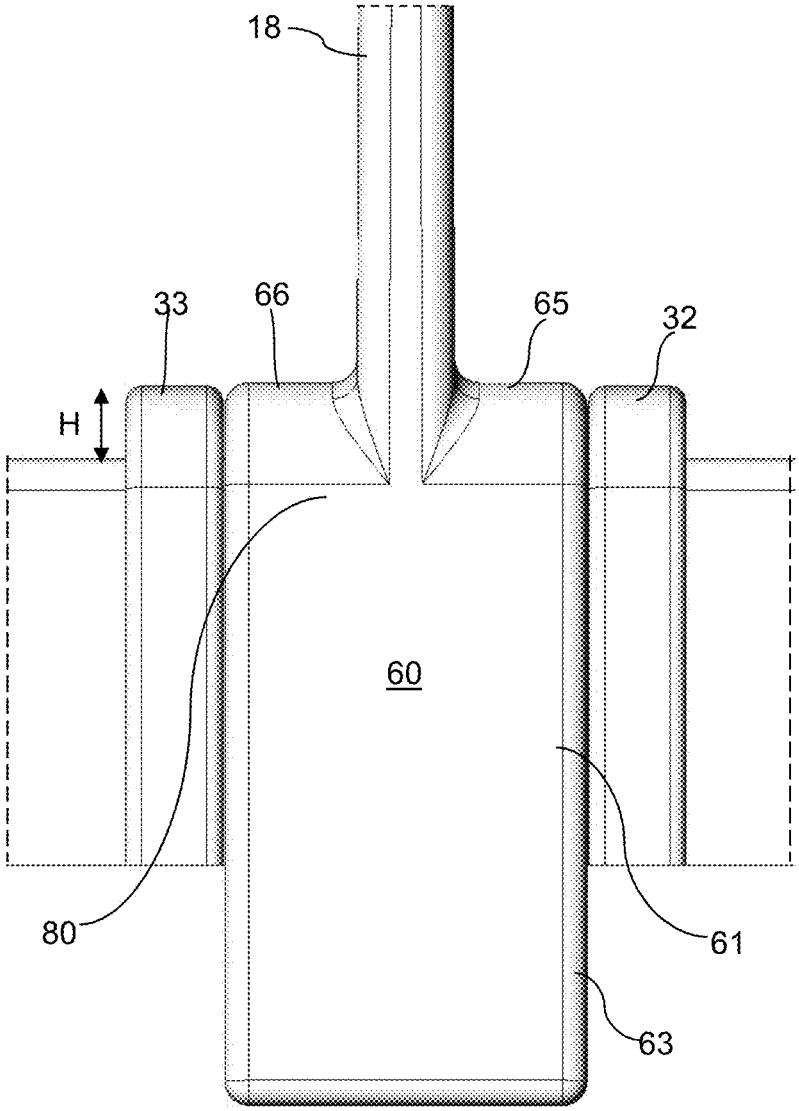
FIG. 9 is a close-up view of detail A taken from FIG. 3.
Figure 10:
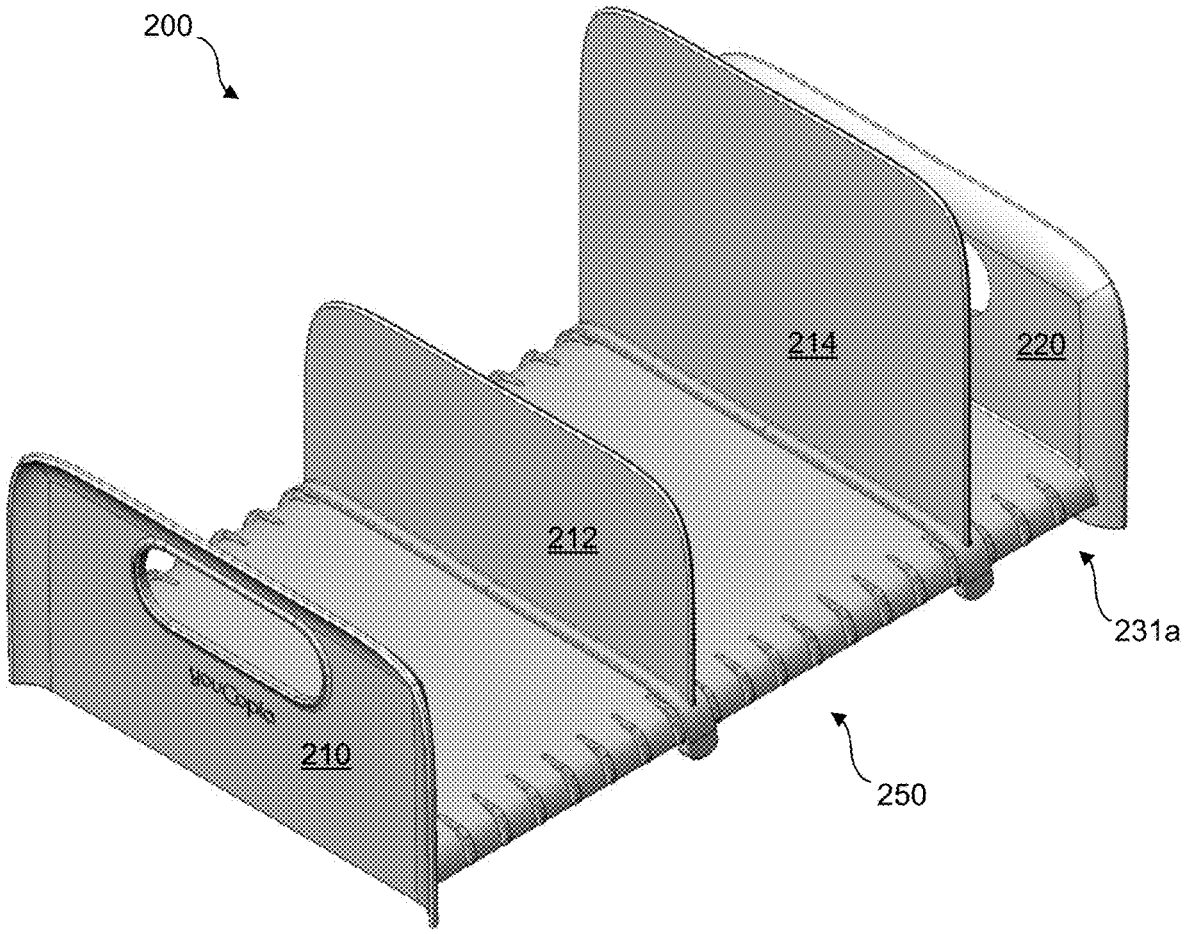
FIG. 10 is a front top perspective view of an alternate freezer rack.

This arrangement is illustrated more clearly in the close-up view of FIG. 9, corresponding to the detail A of FIG. 3. In this illustration, a first connector 60 having an arm 61 and a lower hook 63 is visible, extending beneath one of the dividers 18. The divider base 80 includes a portion on either side of the divider, including a first portion 66 and an opposing second portion 65. The divider base, including the connector 60, is shown seated between an adjacent pair of ribs 32, 33. As seen in FIG. 9, the divider base is snugly received within the slot formed between the pair of ribs, such that the divider base is contacting each of the ribs in the illustrated example. More particularly, the divider base including its connector is in contact with the rib on either side, including along the horizontal portion of the ribs and along the vertical portion which extends down each vertical sidewall of the base platform. In some versions, the divider base width W2 may be greater than the slot width W1 to create an interference fit within the slot.

As further seen in FIG. 9, each of the ribs 32 33 extends above the surface of the base platform by a height H, and preferably the divider base likewise extends above the base platform by the same height when connected to the base platform.

In use, any of the dividers 12-18 may be positioned within any of the base platform slots (for example, slots 40-44). To insert a divider, the divider base is positioned over a desired slot and pressed downward. The slightly inclined lower interior surface of the hook will slide along the outer vertical surface of the base platform within the slot, urging the connector arms outward as the divider is pressed downward. Once the divider and the connectors have reached the full downward travel and the divider platform is seated within a slot, the arms will snap inwardly so that the hook engages the lower surface of the base platform. The snug fit of the divider base within the slot, together with the hooks as described, hold the divider firmly in place. The vertical portions of the ribs interact with the connectors to prevent rotational movement of the dividers, thereby holding them in a vertical orientation. The width of the divider platform and the slots likewise provides for a stable support to prevent the divider from leaning when a force is applied against it because of the insertion of an item to be stored.

A divider may be removed and repositioned by pressing outwardly against the hook inner surface, thereby releasing the hook from the base platform. The divider can then be raised upwardly from the base platform and either removed entirely or repositioned to a different desired slot. Once configured as desired, the rack can be placed in a freezer or another location so that food items can be stored within the spaces formed between the dividers.

Figure 11:
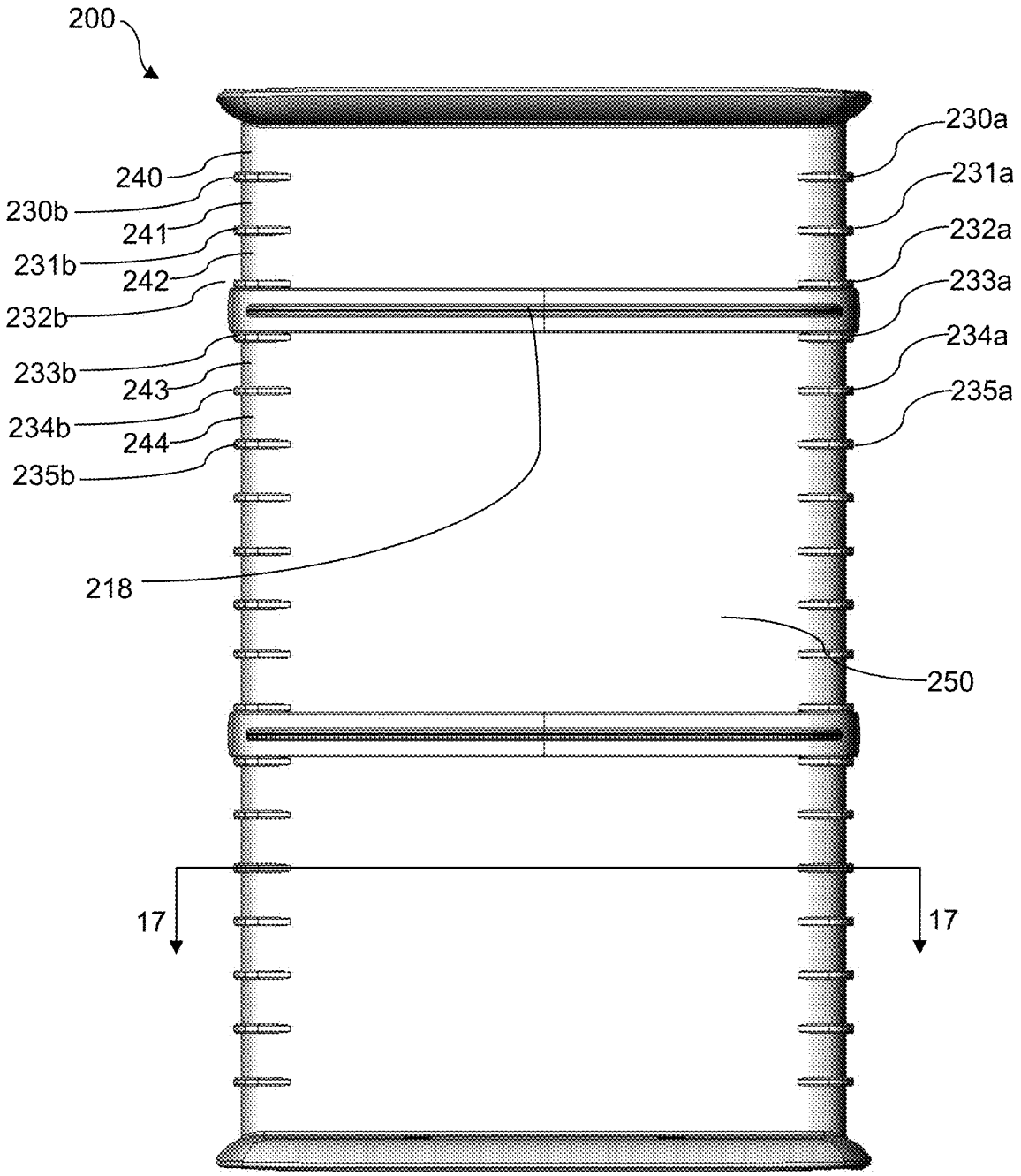
FIG. 11 is a top plan view of the freezer rack of FIG. 10.

An alternate freezer rack 200 is shown in FIGS. 10-16. The alternate version shares much with the embodiment described above, including the base tray or platform 250, end walls 210, 220, and moveable dividers 212, 214. In the alternate embodiment, however, the ribs may not extend fully across the width of the base platform. Thus, as seen in FIG. 11, the plurality of ribs is further configured as a plurality of first side ribs 230*a*, 231*a*, 232*a*, 233*a*, 234*a*, 235*a* positioned on one side of the base platform, and a plurality of second side ribs 230*b*, 231*b*, 232*b*, 233*b*, 234*b*, 235*b* positioned on the opposite side of the base platform. In this example, the first side ribs and the second side ribs are separated from one another by the majority of the expanse of the width of the base platform.

Figure 12:
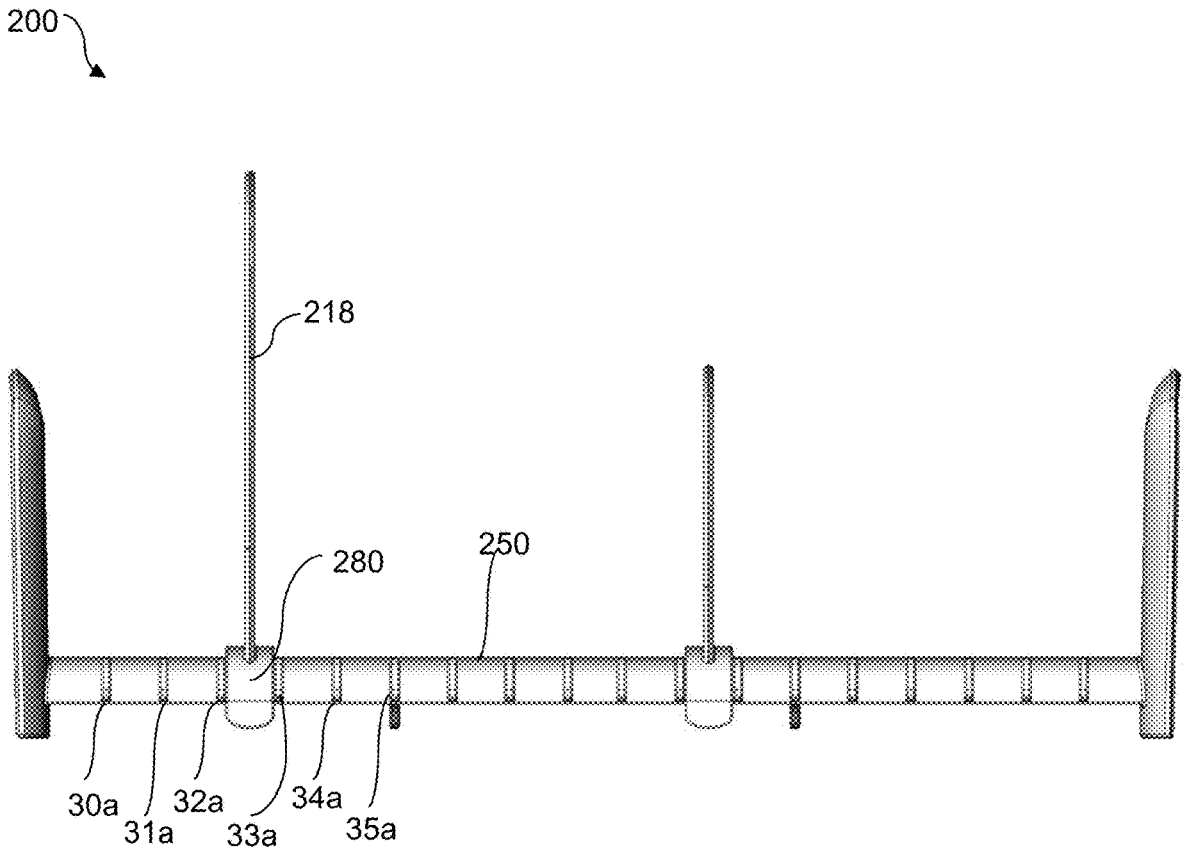
FIG. 12 is a front elevational view of the freezer rack of FIG. 10, the rear elevational view being a mirror image.
Figure 13:
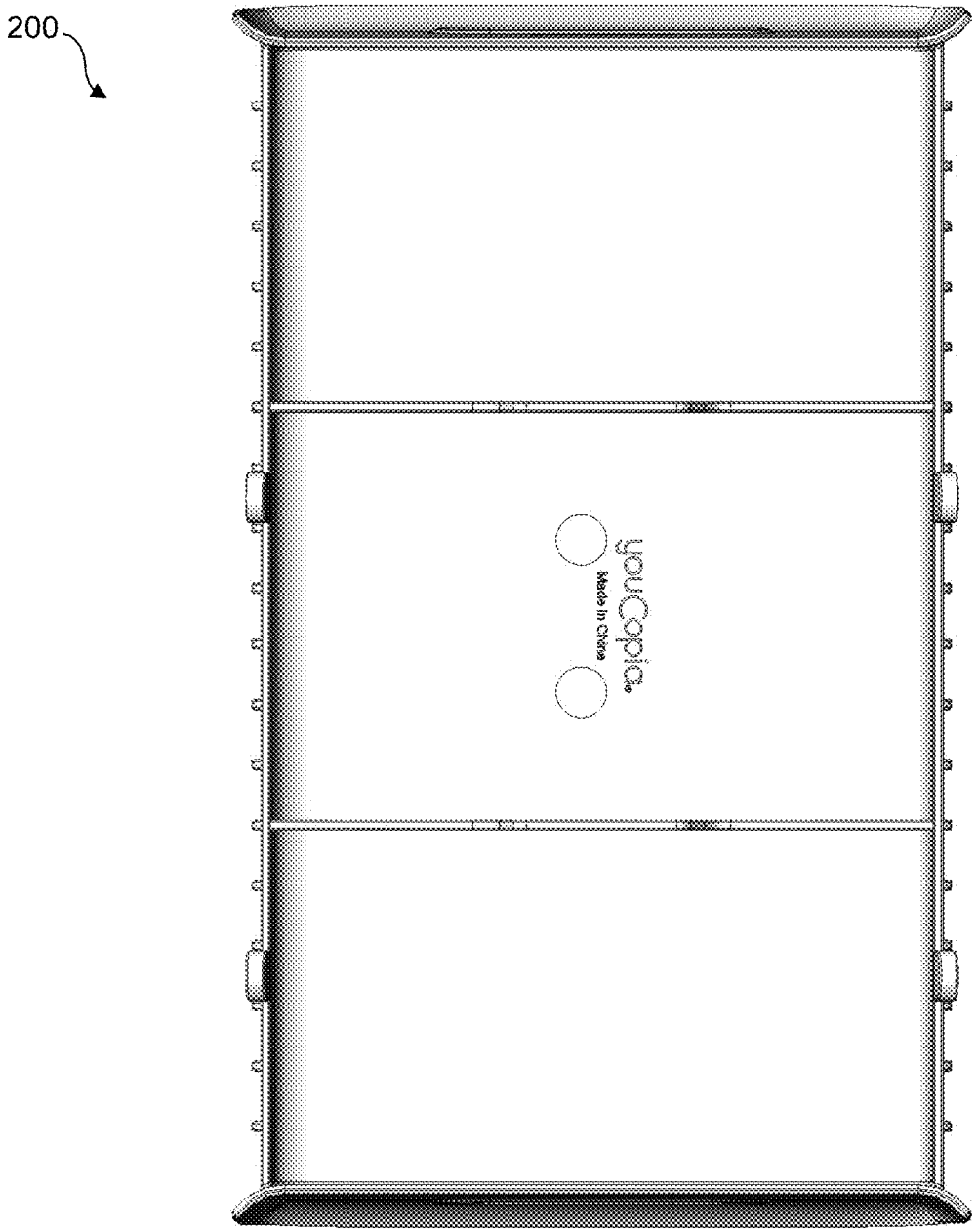
FIG. 13 is a bottom plan view of the freezer rack of FIG. 10.
Figure 14:
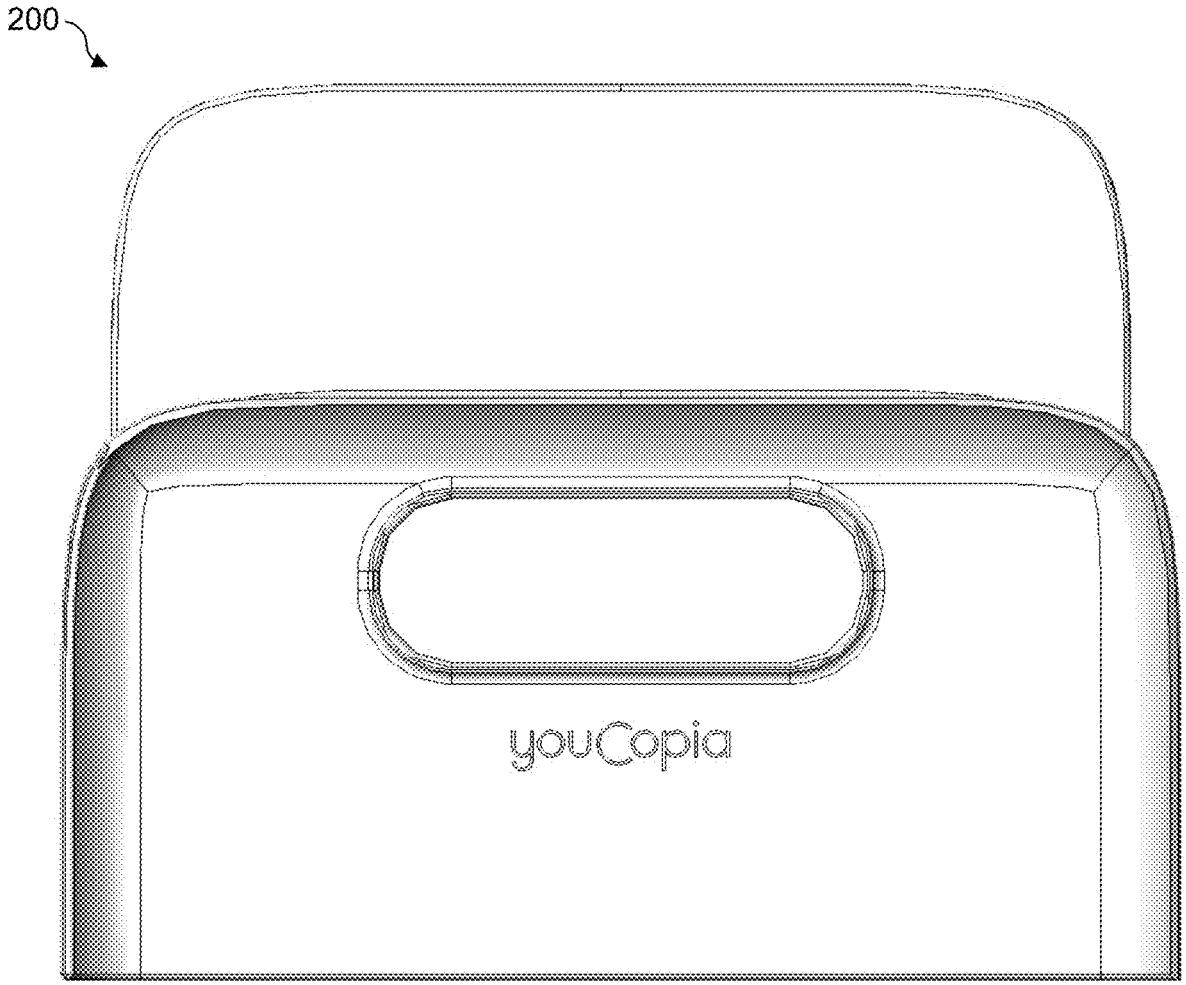
FIG. 14 is a left side elevational view of the freezer rack of FIG. 10, the right side elevational view being a mirror image.

A divider, for example divider 218 as seen in FIG. 12, may be seated on the base platform by positioning it in a channel defined between adjacent pairs of side ribs, in the manner as describe above with respect to the ribs.

Figure 15:
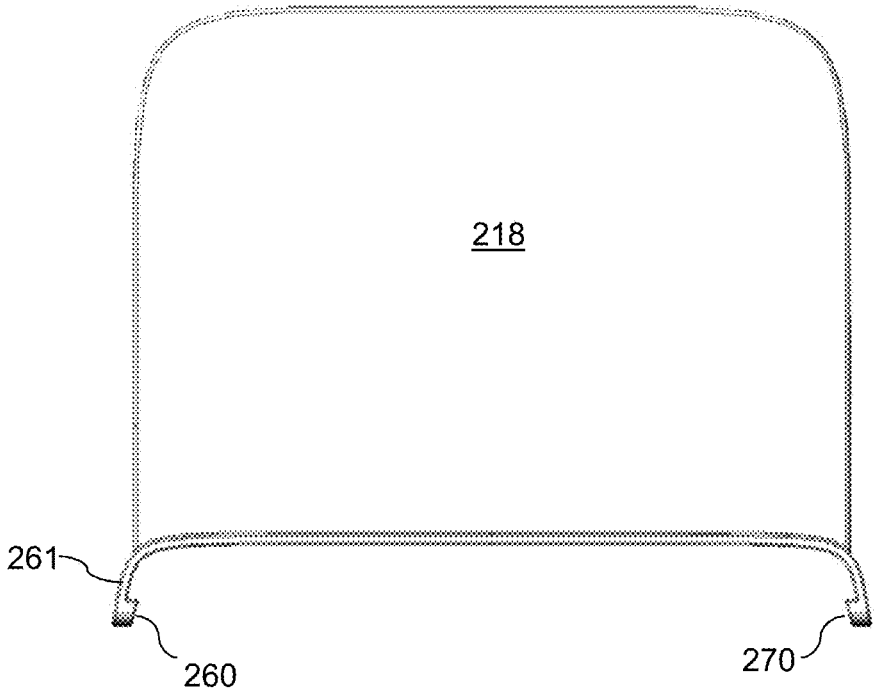
FIG. 15 is a left side elevational view of a divider for a freezer rack.
Figure 16:
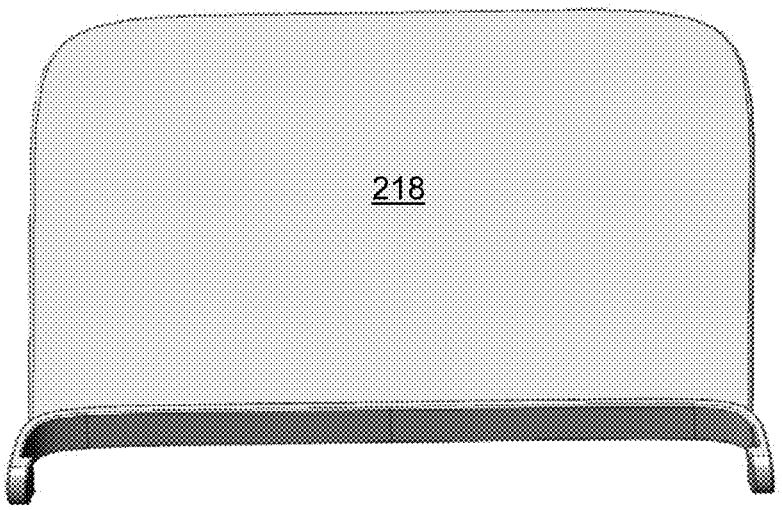
FIG. 16 is a bottom perspective view of a divider for a freezer rack.

In one version of the invention, for either of the illustrated embodiments, the connectors may be curved. In FIG. 6, the connector 60 is illustrated with a connector arm 61 that extends sharply downward, and nearly perpendicularly, from the divider base 80. As seen in FIG. 15, however, the connector 260 is shown with a connector arm 261 that curves as it extends downwardly, forming an arc.

Figure 17:
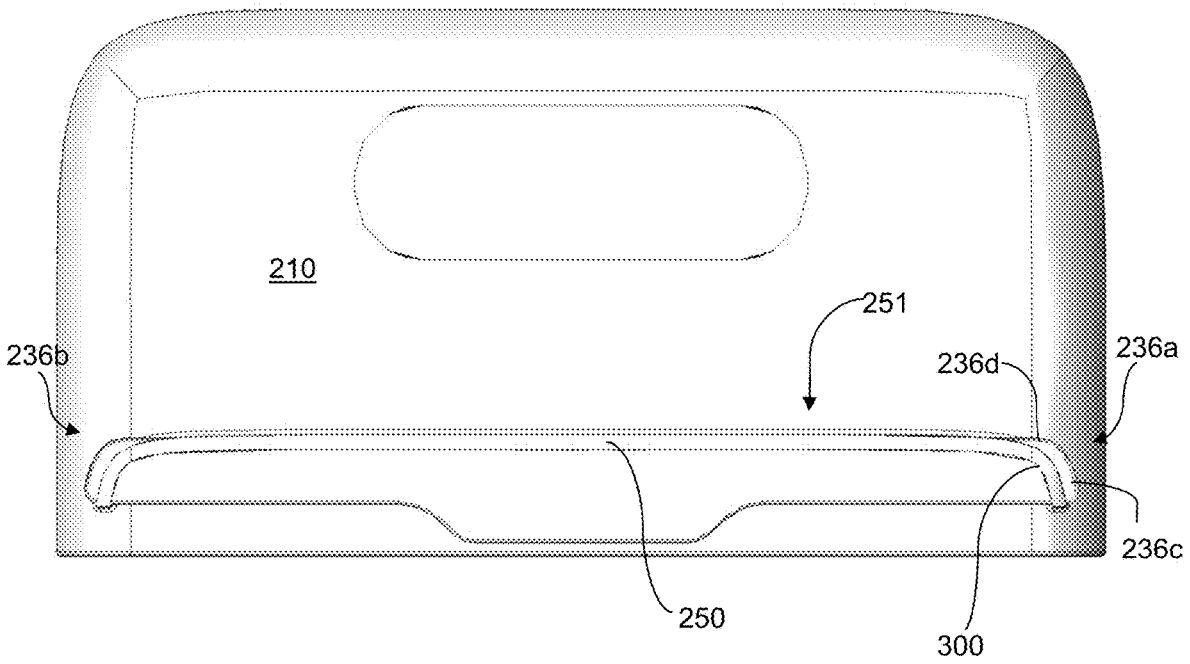
FIG. 17 is a sectional view taken through section lines 17-17 in FIG. 11.

The base platform 250 and ribs may also have a corresponding curvature, as seen in the sectional view of FIG. 17. An exemplary one of the side ribs 236*a* is illustrated and described for simplicity of illustration, but preferably all of the side ribs are configured in the same manner. At opposite ends of the base platform 250, the base platform curves downwardly, reaching an apex 300 in which the upper surface 251 of the base platform is more vertical than horizontal, and thus forms the sidewall more than the upper surface. The side rib 236*a* includes a vertical portion 236*c* and a horizontal portion 236*d*, following the curvature of the base platform. Most preferably, in one version the side rib 236*a* does not extend above the top of the upper surface 251 of the base platform. Thus, in the illustrated example, the arms of the connectors have a curvature that matches that of the first and second ends of the base platform.

Most preferably, each such rib on each of the first side and the second side includes a vertical portion and a horizontal portion.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

I claim:

1. A freezer rack, comprising:

a base platform having a first end and an opposing second end, with a first side and an opposing second side positioned between the first end and the second end;

a base platform length defined between the first end and the second end, and a base platform width defined between the first side and the second side;

the base platform further having an upper surface, a lower surface, a first sidewall at the first end between the upper surface and the lower surface, and an opposing second sidewall at the second end between the upper surface and the lower surface;

a plurality of ribs, each of the ribs extending along the first sidewall, a portion of the base platform, and along the second sidewall, the plurality of ribs further being spaced apart from one another between the first end and the second end to define a plurality of channels between adjacent ribs from among the plurality of ribs; and at least one divider removably attachable to the base platform within a selected one of the plurality of channels, the at least one divider having an upper wall extending from a divider base, the divider base terminating in a first connector and an opposing second connector, the first connector being releasably securable to the lower surface of the base platform at the first sidewall and the second connector being releasably securable to the lower surface of the base platform at the second sidewall.

2. The freezer rack of claim 1, wherein each of the ribs extends continuously from the first sidewall, across the width of the base platform, and along the second sidewall.

3. The freezer rack of claim 1, wherein each of the ribs comprises a first side rib and a second side rib, and wherein the channels are defined between adjacent pairs of the first side ribs and the second side ribs.

4. The freezer rack of claim 3 wherein the first connector terminates in a first hook attachable to the lower surface of the base platform, and the second connector terminates in a second hook attachable to the lower surface of the base platform.

5. The freezer rack of claim 4, wherein the first connector includes a first flexible arm, the first flexible arm being in contact with the first sidewall when the at least one divider is mounted to the selected one of the plurality of channels.

6. The freezer rack of claim 4, wherein the second connector includes a second flexible arm, the second flexible arm being in contact with the second sidewall when the at least one divider is mounted to the selected one of the plurality of channels.

7. The freezer rack of claim 6, wherein the first hook terminates in a first inclined inner surface, the first inclined inner surface engaging the first sidewall when the at least one divider is pressed downwardly into the selected one of the plurality of channels.

8. The freezer rack of claim 6, wherein the divider base comprises a divider base width and each of the plurality of channels comprise a channel width, the divider base width being substantially equal to the channel width.

9. The freezer rack of claim 6, wherein the divider base comprises a divider base width and each of the plurality of channels comprise a channel width, the divider base width being greater than the channel width.

10. The freezer rack of claim 6, wherein the first end comprises a first vertical end wall and the second end comprises a second vertical end wall.

11. A freezer rack, comprising:

a base platform having a first end and an opposing second end, with a first side and an opposing second side positioned between the first end and the second end;

a base platform length defined between the first end and the second end, and a base platform width perpendicular to the length and defined between the first side and the second side;

the base platform further having an upper surface, a lower surface configured as one or more feet, a first sidewall along the first end between the upper surface and the lower surface, and an opposing second sidewall along the second end between the upper surface and the lower surface;

a plurality of ribs, each of the plurality of ribs including a first side rib at the first side of the base platform and a second side rib at the second side of the base platform, the plurality of ribs further being spaced apart from one another between the first end and the second end to define a plurality of channels between adjacent side ribs from among the plurality of ribs, each of the plurality of channels having a common channel width; and a plurality of dividers removably attachable to the base platform within a corresponding selected one of the plurality of channels, each of the dividers having an upper wall extending from a divider base, the divider base terminating in a first connector and an opposing second connector, the first connector being releasably securable to the base platform at the first sidewall and the second connector being releasably securable to the base platform at the second sidewall.

12. The freezer rack of claim 11, wherein the upper surface of the first end of the base platform is curved as it transitions to the first sidewall and the upper surface of the second end of the base platform is curved as it transitions to the second sidewall, each of the first and second connectors having a matching curvature.

13. The freezer rack of claim 12 wherein the first connector terminates in a first hook attachable to the base platform, and the second connector terminates in a second hook attachable to the base platform.

14. The freezer rack of claim 13, wherein the first hook is attachable to the lower surface of the base platform and the second hook is attachable to the lower surface of the base platform.

15. The freezer rack of claim 14, wherein the first connector includes a first flexible arm, the first flexible arm being in contact with the first sidewall when the at least one divider is mounted to the selected one of the plurality of channels, and further wherein the second connector includes a second flexible arm, the second flexible arm being in contact with the second sidewall when the at least one divider is mounted to the selected one of the plurality of channels.

16. The freezer rack of claim 15, wherein the first hook terminates in a first inclined inner surface, the first inclined inner surface engaging the first sidewall when the at least one divider is pressed downwardly into the selected one of the plurality of channels.

17. The freezer rack of claim 15, wherein the divider base is in contact with the adjacent ribs when the divider is positioned within the corresponding selected one of the plurality of channels.

18. The freezer rack of claim 15, wherein the divider base comprises a divider base width, the divider base width being greater than the channel width.

19. The freezer rack of claim 5, wherein the first end comprises a first vertical end wall and the second end comprises a second vertical end wall.

20. The freezer rack of claim 5, wherein the at least one divider comprises a plurality of dividers.

* * * * *